United States Patent [19]

Poldervaart et al.

[11] Patent Number: 4,917,038

[45] Date of Patent: Apr. 17, 1990

[54] MOORING SYSTEM WITH QUICK-ACTION COUPLING

[75] Inventors: Leendert Poldervaart; Michael Stambouzos, both of La Turbie, France

[73] Assignee: Single Buoy Moorings Inc., Marly, Switzerland

[21] Appl. No.: 319,316

[22] Filed: Mar. 6, 1989

[30] Foreign Application Priority Data

Apr. 11, 1988 [NL] Netherlands ..... 8800927

[51] Int. Cl.[4] ..... B63B 22/02

[52] U.S. Cl. ..... 114/230; 441/3

[58] Field of Search ..... 114/230, 293, 294; 441/3, 5; 166/354, 355

[56] References Cited

U.S. PATENT DOCUMENTS 4,665,856 5/1987 Pedersen ..... 114/230

FOREIGN PATENT DOCUMENTS 0079404 5/1983 European Pat. Off. ..... 114/230

58-202185 11/1983 Japan .

2019800 11/1979 United Kingdom ..... 114/230

*Primary Examiner*—Joseph F. Peters, Jr.

*Assistant Examiner*—Ed Swinehart

*Attorney, Agent, or Firm*—Young & Thompson

[57] ABSTRACT

Mooring system, comprising a mooring tower (3, 13, 22, 27), a ship (1) and a rigid arm (7, 15, 24, 31) between a horizontal pivot at the ship or the tower and a weight loaded tensionable connecting element (9, 29) suspended from the tower or the ship respectively, the system comprising a quick action coupling between the tower and the ship, as well as structure (12, 19, 20, 21, 26, 34) to control the behaviour of the disconnected arm.

6 Claims, 2 Drawing Sheets

MOORING SYSTEM WITH QUICK-ACTION COUPLING

The invention relates to a mooring system comprising a mooring device fixed relative to the water bottom, a floating device such as a ship, and a connection between the mooring device and the ship, comprising a rigid arm one end of which is coupled rotatably about a horizontal axis, either to the mooring device or to the ship, while the other end is fixed to a tensionable connecting element which is suspended from the ship or from the mooring device, said connection being tensioned by a weight.

Such a mooring system is known, for example from French Patent Specification 2,420,475 or, for example, from Dutch Patent Application 8203434.

The known mooring system provides a high degree of freedom of movement for the ship relative to the mooring device, while the weight can still produce an adjusting force when the ship threatens to drift too far away from the mooring device under the influence of external conditions such as wind and waves.

The mooring device fixed relative to the water bottom can be in any suitable form, such as a bottom anchor, a tower remaining below water level, a tower projecting above it, or a device floating on top of the water, such as a buoy.

In very heavy weather conditions and/or arctic conditions the problem can occur that the connection between ship and mooring device has to be broken. This often has to take place very quickly.

In order to achieve this, it has already been proposed in Dutch Patent Application 8100936, laid open for inspection, that a quick-action coupling be fitted between a ship provided with a fixed arm and a rotary table with anchor chains, so that in an emergency case the ship can break the connection immediately and sail away. The rotary table with anchor chains can in this case form part of a buoy, with or without adjustable buoyancy. It is then easy to let an iceberg pass.

This possibility does not exist in the flexible mooring system mentioned in the preamble.

The object of the invention is then to improve this known mooring system in such a way that a rapid break of the connection is possible in a manner which also permits restoration of the connection in a reasonably simple manner, in such a way that the ship and connection can move away together.

This object is achieved according to the invention in that this connection contains a quick-action coupling, and the connection is provided with means with which at least the arm when uncoupled can be held in a controllable position relative to the ship or relative to the mooring device.

The quick-action coupling ensures the breaking of the connection, but this in itself is not enough. If the quick-action coupling is placed near the mooring device, breaking of the coupling results in the arm still coupled to the connecting element on the ship falling down. Finding the arm again and replacing it in the correct position, not to mention the conflict with underwater objects, constitutes a problem, because these are objects of great dimensions. If the quick-action coupling is beside the weight or near the ship, the same problem occurs, for the arm then also falls down and can be damaged by striking the mooring device.

Apart from the quick-action coupling, means are thus also needed to hold the arm in a controllable state when uncoupled, and these means will depend as regards place or design on the way in which the mooring system is designed.

If the rigid arm is on the mooring device, then means are necessary to ensure that after uncoupling the rigid arm is taken to an upright position and held there if the quick-action coupling is near the mooring device. These means can be formed by a chamber with adjustable buoyancy or by a weight present on an extension of the rigid arm which is located past the connection to the tensionable connecting element. In both cases, after uncoupling a moment is exerted on the rigid arm to take the arm upwards, so that it reaches the area of the bow of the ship, and can be picked up there and made fast. The ship can then sail away, while the arm is held fast in a controlled position.

For making the connection, use can be made again of the adjustable buoyancy, by reducing it after the upward-projecting end of the arm has been freed from the ship. If the moment which raises the arm is supplied by a eight present on an extension of the arm, a chamber with adjustable buoyancy can be provided near said weight, of such size that it can neutralize the couple of the weight on the arm. Then again, the arm can be swung back in a controlled manner to restore the coupling.

If the quick-action coupling is near the weight or near the point where the connecting element is suspended from the ship, the arm will fall down on uncoupling if further measures are not taken. If a chamber with adjustable buoyancy is provided in the arm, preferably near the quick-action coupling, the position of the arm can be controlled, i.e. the position can remain as it was, and the position can be changed by allowing the arm to drop down in a controlled manner. If the quick-action coupling is near where the connecting element is fastened to the ship, the chamber with adjustable buoyancy is in this connecting element, so that after uncoupling this chamber goes into the water and acts as a buoy. The arm can then be dropped further, so that the buoy also disappears under water, and the arm can be returned easily by giving the buoy more buoyancy, so that it is on the surface of the water, after which the connection can be restored with hoisting means.

It is pointed out that Dutch Patent Application 7805043 discloses a connection between a ship and a tower connected to the water bottom in such a way that it pivots, the connection - which is formed by a rigid arm - having a quick-action coupling. However, in this case it is a different mooring system.

The invention will now be explained in greater detail with reference to the drawings.

Figure 1:
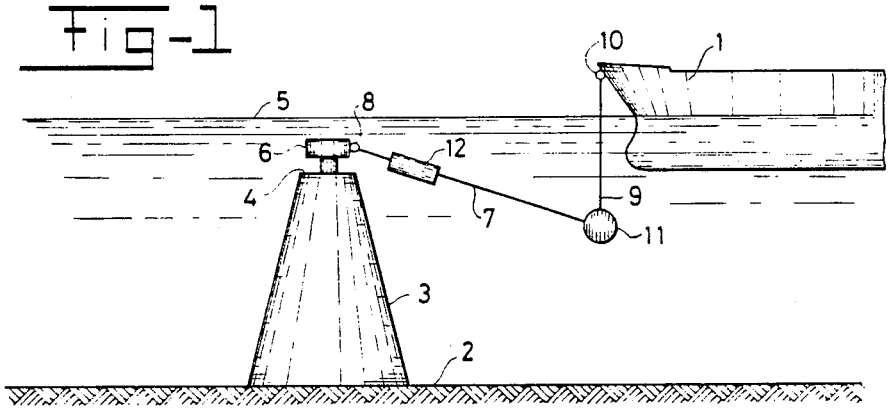
FIG. 1 shows schematically in side view an embodiment of the system according to the invention.

FIG. 1 shows a ship 1 and a tower 3, which is placed on the bottom 2, and whose top end 4 is under the water level 5. The tower is provided at 6 with a rotary table which permits rotation about a vertical axis, and extending from this rotary table is a connection formed by the rigid arm 7 whose top end is fixed to the rotary table at 8 so that it pivots about a horizontal axis and can have a quick-action coupling there (not shown). The bottom end of the arm 7 is fastened to a tensionable connecting element 9, which can be a rod, cable or chain whose top end is suspended at 10 from the bow of the ship 1. Reference number 11 indicates a weight which holds the connection under tension and provides an adjusting force when the connecting element 9 moves out of the vertical position.

The arm is provided at 12 with a chamber with adjustable buoyancy. The arm can thus be lowered by means of this chamber 12. If this chamber has been given buoyancy by pumping out or blowing out, on uncoupling near the hinge 8 the arm 7 will swing upwards, under the influence of the couple exerted by the chamber 12, about the connection near the weight 11 with the tensionable element 9.

Figure 2:
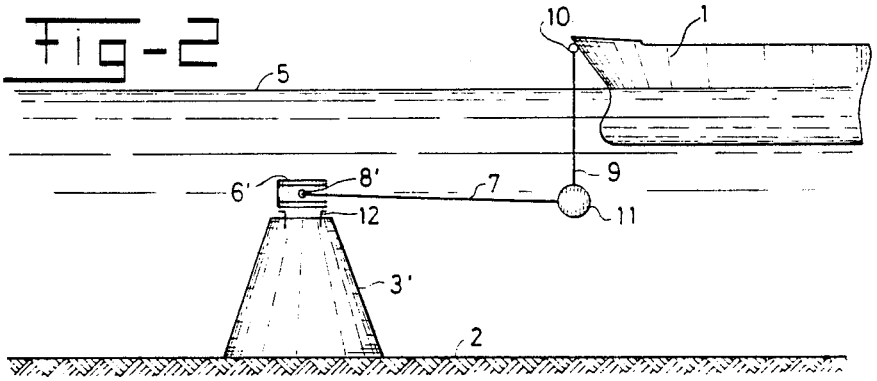
FIG. 2 shows in the same way as FIG. 1 another embodiment.

The embodiment of FIG. 2 differs from that of FIG. 1 only in that the tower 3' is shorter and the rotary table 6' to which the arm 7 is coupled in a pivoting manner at 8' is itself designed as an element with buoyancy and at its bottom side is provided with couplings 12 which permit a connection to or rapid disconnection from the top end of the tower. With this embodiment also, giving buoyancy to the chamber provided for this purpose in the rotary table will make it possible to swing the arm upwards until the top end is in front of the bow of the ship 1.

Figure 3:
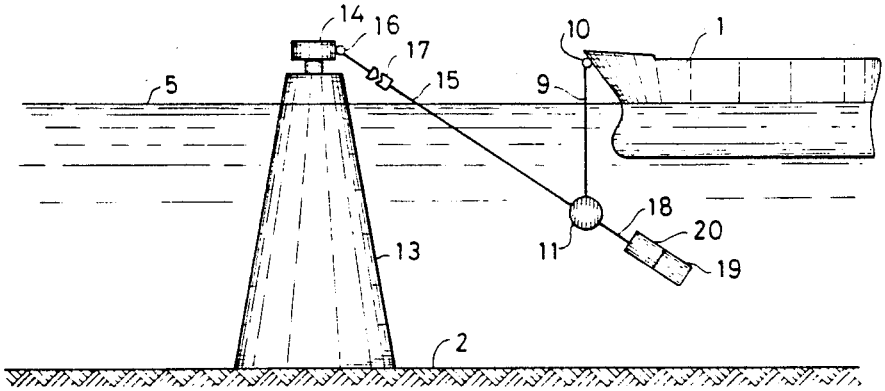
FIG. 3 shows a third embodiment.

In the embodiment according to FIG. 3 the tower projects above the surface 5 of the water. The tower has a rotary table 14 rotatable about a vertical axis and the arm 15 is hingedly connected at 16 to the rotary table. A quick-action coupling is provided at 17.

Beyond the tensionable connecting element, and indeed beyond the weight 11, the arm 15 has an extension 18 carrying a weight 19. This weight exerts a couple round the hinged connection between the arm 15 and the tensionable element 9, so that when the coupling 17 is disconnected the arm 15 swings up. Near the weight 19 there can be a chamber 20 whose buoyancy is adjustable. When this chamber is full, it will support the action of the weight, but when empty this chamber will counteract the action of the weight and preferably be able to raise it to such an extent that the arm can swing back to the position in which a coupling can be made.

Figure 4:
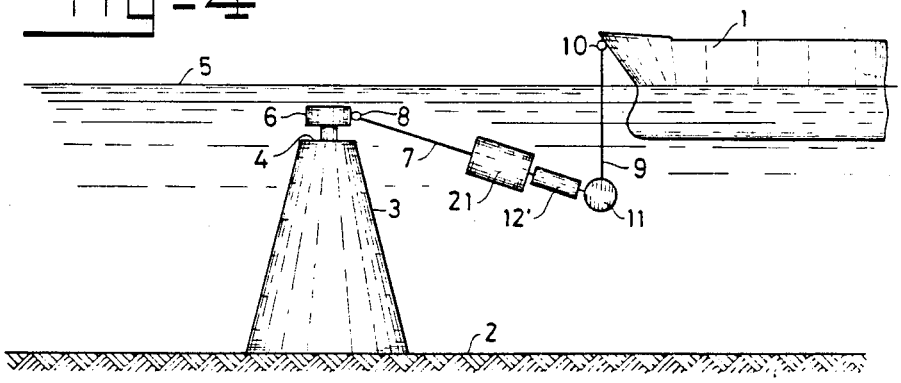
FIG. 4 shows a fourth embodiment.

The embodiment of FIG. 4 differs from that of FIG. 1 in that the quick-action coupling 12' is placed near the weight 11. The arm 7 is also provided with a float 21 with adjustable buoyancy. When uncoupling takes place the ship with the weight suspended therefrom can sail away, and the weight can easily be hoisted up if this is felt to be necessary. The position of the arm 7 can then be controlled further by means of the float 21, in such a way that the arm is held in the original position or lowered. When the connection is being restored this float can also be used to take the arm with the coupling to water level 5, so that during lowering of the connecting elements 9 with the weight 11 one can see what one is doing.

Figure 5:
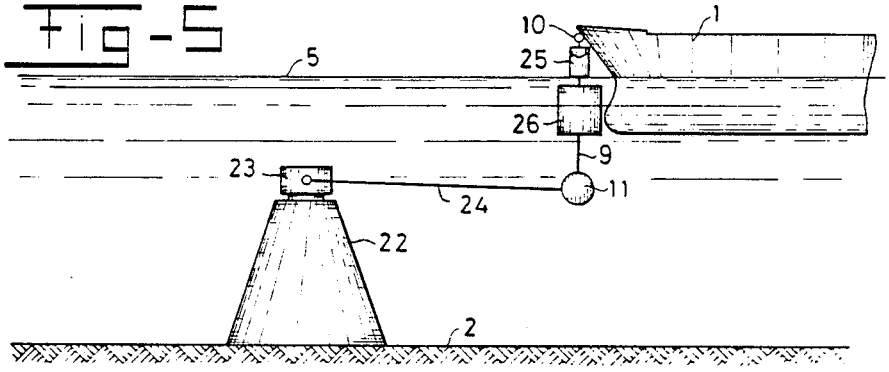
FIG. 5 shows a fifth embodiment.

In the embodiment of FIG. 5 use is made of an underwater tower 22 with a rotary table 23 from which a rigid arm 24 runs to the weight 11. The quick-action coupling is shown at 25 and is near the suspension point 10 of the tensionable connecting element 9. Below the quick-action coupling 25 is a float 26, which can have adjustable buoyancy. On uncoupling, the arm 24 swings downwards, and the float 26 floats in the water. The buoyancy must be sufficient to bear the weight and the arm. If the buoyancy is adjustable, the float 26 acting as a buoy can be lowered.

The advantage of this embodiment is that the connection can disappear entirely under the water and there will no longer be any parts on the ship which could hamper the manoeuvrability of the ship.

Figure 6:
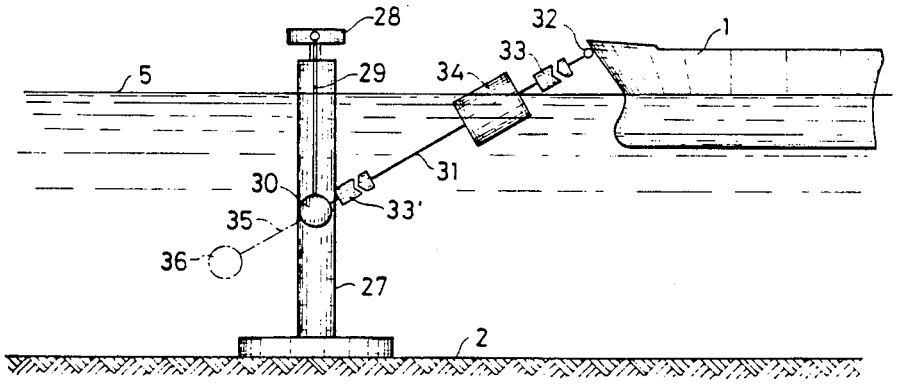
FIG. 6 shows schematically several other possible embodiments.

In the embodiment of FIG. 6 the mooring device comprises a tower 27 having at the top a rotary table 28 from which tensionable connecting elements 29 bearing a weight 30 are suspended at either side of the tower 27. The rigid arm 31 is hingedly connected at 32 to the ship 1 and at its bottom end to the weight 30. The quick-action coupling 33 can be located near the horizontal hinge pin 32. The arm 31 then has a float 34 by means of which the arm can be held in the correct position and can also be taken under water.

The quick-action coupling can also be located near the weight 30, as indicated by 33'. On uncoupling, the arm then remains on the ship, and in this case also a float, such as the float 34, ensures that the arm is held in a controllable position.

The arm 31 can also have an extension 35 with a weight 36 which after uncoupling of the quick-action coupling 33 ensures that the arm 31 is swung upwards in its entirety and comes to rest against the tower. In this embodiment also the ship sailing away is left only with the horizontal hinge pin 32 with part of the quick-action coupling.

This weight can also be combined with a float, such as the float 20 in FIG. 3 but, since we are concerned here with a suspension from a tower, it is also possible to return the arm to the working position by lifting the weight 36 using a hoisting cable.

We claim:

1. Mooring system comprising a mooring device fixed relative to the water bottom, a floating device such as a ship, and a connection between the mooring device and the ship, comprising a rigid arm, one end of which is coupled rotatably about a horizontal axis, either to the mooring device or to the ship, while the other end is fixed to a tensionable connecting element, which is suspended from the other of the ship or mooring device and which is tensioned by a weight disposed adjacent one end of the arm, said connection having a quick-action coupling and means with which the position of the arm can be controlled after releasing the coupling to disconnect the mooring device and the ship from each other, said means being a chamber with adjustable buoyancy, adjacent to the quick-action coupling and adjacent to the end of the arm remote from the weight.

2. Mooring system comprising a mooring device fixed relative to the water bottom, a floating device such as a ship, and a connection between the mooring device and the ship, comprising a rigid arm, one end of which is coupled rotatably about a horizontal axis, either to the mooring device or to the ship, while the other end is fixed to a tensionable connecting element, which is suspended from the other of the ship or mooring device and which is tensioned by a weight, said connection having a quick-action coupling and means with which the position of the arm can be controlled after releasing the coupling to disconnect the mooring device and the ship from each other, said means being a chamber with adjustable buoyancy, adjacent to the quick-action coupling and adjacent to the weight.

3. Mooring system comprising a mooring device fixed relative to the water bottom, a floating device such as a ship, and a connection between the mooring device and the ship, comprising a rigid arm, one end of which is coupled rotatably about a horizontal axis, either to the mooring device or to the ship, while the other end is fixed to a tensionable connecting element, which is suspended from the other of the ship or mooring device and which is tensioned by a weight, said connection having a quick-action coupling and means with which the position of the arm can be controlled after releasing the coupling to disconnect the mooring device and the ship from each other, said means being a chamber with adjustable buoyancy, adjacent to the quick-action coupling, said chamber and quick-action coupling both being part of the tensionable connecting element.

4. Mooring system comprising a mooring device fixed relative to the water bottom, a floating device such as a ship, comprising a rigid arm, one end of which is coupled rotatably about a horizontal axis, either to the mooring device or to the ship, while the other end is fixed to a tensionable connecting element, which is suspended from the other of the ship or mooring device and which is tensioned by a weight, said connection having a quick-action coupling and means with which the position of the arm can be controlled after releasing the coupling to disconnect the mooring device and the ship from each other, said means being a chamber with adjustable buoyancy on the arm at a location between the ends of said arm and remote from the quick-connection coupling.

5. Mooring system comprising a mooring device fixed relative to the water bottom, a floating device such as a ship, and a connection between the mooring device and the ship, comprising a rigid arm, one end of which is coupled rotatably about a horizontal axis, either to the mooring device or to the ship, while the other end is fixed to a tensionable connecting element, which is suspended from the other of the ship or mooring device and which is tensioned by a weight, said connection having a quick-action coupling and means with which the position of the arm can be controlled after releasing the coupling to disconnect the mooring device and the ship from each other, said means being a chamber with adjustable buoyancy adjacent to the quick-action coupling but remote from the weight and close to the horizontal axis by means of which the arm is connected with the ship, said arm having an extension beyond the weight extending in the direction opposite the ship, said extension carrying a weight.

6. Mooring system comprising a mooring device fixed relative to the water bottom, a floating device such as a ship, and a connection between the mooring device and the ship, comprising a rigid arm, one end of which is coupled rotatably about a horizontal axis, either to the mooring device or to the ship, while the other end is fixed to a tensionable connecting element, which is suspended from the other of the ship or mooring device and which is tensioned by a weight, said connection having a quick-action coupling and means with which the position of the uncoupled arm can be controlled, said means being a chamber with adjustable buoyancy which chamber is provided on an extension of the arm extending past the coupling point of the arm to the connecting element which extension bears said weight whereas the chamber adjacent to the weight has an adjustable buoyancy of a magnitude such that it can neutralize the couple of the weight on the arm, said arm carrying the quick-action coupling at the end of the arm opposite the weight.

* * * * *